United States Patent [19]

Campbell et al.

[11] Patent Number: 4,742,202

[45] Date of Patent: May 3, 1988

[54] MICROWAVE APPARATUS FOR HEATING CONTAINED LIQUID

[75] Inventors: Nancy L. Campbell; John G. Pinto; John A. Drewe, all of San Diego, Calif.; Gerald W. Ghing, Kaneohe, Hi.; Franklin R. Borkat, La Mesa, Calif.

[73] Assignee: The United State of America as represented by the Secretary of the Navy

[21] Appl. No.: 506,169

[22] Filed: Jun. 20, 1983

[51] Int. Cl.[4] ..... H05B 6/78

[52] U.S. Cl. ..... 219/10.55 F; 219/10.55 M; 219/10.55 R; 366/219

[58] Field of Search ..... 219/10.55 F, 10.55 E, 219/10.55 R; 366/219, 218, 208; 99/421 R, 421 HV

[56] References Cited

U.S. PATENT DOCUMENTS

| | | | |
|---|---|---|---|
| 804,935 | 11/1905 | Duffy et al. | 366/219 |
| 3,427,422 | 2/1969 | Muller | 219/10.55 F |
| 3,436,506 | 4/1969 | Smith | 219/10.55 F |
| 3,462,575 | 8/1969 | Holaday | 219/10.55 R |
| 3,607,478 | 9/1971 | Henninges et al. | 366/219 |
| 3,737,608 | 6/1973 | Nagao et al. | 219/10.55 R |
| 4,336,435 | 6/1982 | Kashyap et al. | 219/10.55 R |
| 4,427,866 | 1/1984 | Pauly et al. | 219/10.55 FX |

*Primary Examiner*—Philip H. Leung

*Attorney, Agent, or Firm*—Robert F. Beers; Ervin F. Johnston; Thomas Glenn Keough

[57] ABSTRACT

An apparatus is provided for heating contained liquid, and more particularly for thawing frozen blood components which are contained in a bag. The heating apparatus includes a microwave oven which has a cavity for receiving objects to be heated. A track is mounted in the oven cavity and has a peak and a valley with respect to the cavity floor. A tray is provided for supporting the liquid container. A device is provided for pivotally supporting the tray within the cavity with the tray in engagement with the track means, and a device is located within the oven for imparting relative motion between the tray and the track. With this arrangement the liquid container can be moved in a rocking motion to cause a mixing between the warm and cold portions of the liquid, and in particular with regard to frozen blood will cause the thawed liquid portions of the blood to flow over the still frozen portions so as to dissipate heat therebetween.

4 Claims, 6 Drawing Sheets

MICROWAVE APPARATUS FOR HEATING CONTAINED LIQUID

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention pertains to a microwave apparatus for heating contained liquid, and more particularly for thawing a bag of frozen blood components.

The prevailing method of thawing bags of frozen blood components is to insert the bag into a warm water bath. While the warm water bath distributes heat over the entire surface of the bag it is quite time consuming and sometines introduces bacterial contamination into the bag. In order to overcome the bacterial contamination problem some users have put the bag of blood components into a second hermetically sealed bag before insertion into the warm water bath. This second bag however, can easily be ripped by the still frozen blood unit, and prevention of water contact cannot be guaranteed.

An interesting approach to thawing blood components is to use a microwave oven. A microwave oven particularly adapted for heating frozen blood components is shown in U.S. Pat. No. 4,336,435. This patent teaches a major modification to an existing microwave oven by penetrating the side of the oven with a shaft which is operated by a motor mounted exteriorly from the over cavity. The shaft extends into the oven cavity and has a holder for positioning a blood bag in a vertical position. When the motor is operated the blood bag is rocked and/or rotated during oven operation.

It is particularly important in thawing blood components by microwaves to ensure that the blood does not boil. Without proper movement or agitation of the blood, microwave energy will concentrate on one portion of the blood to cause over heating while other portions of the blood still remain frozen. It is therefore important in microwave heating to ensure that the thawed warmer portions of the blood are caused to flow over the frozen portions so as to distribute the heat and prevent portions of the blood from boiling. It is also desirable to provide an arrangement for heating frozen blood in a standard microwave oven so that the expense of the heating arrangement can be minimized. It is also important for the heating apparatus to position the bag of blood for maximum reception of microwave energy.

SUMMARY OF THE INVENTION

The present invention provides an improved microwave apparatus for heating contained liquid, and more particularly for thawing frozen bags of blood components without any alteration to a commercially available microwave oven. This has been accomplished by mounting a track in the oven cavity on the oven floor. The track has a peak and a valley with respect to the floor. A tray is provided for receiving the liquid container or bag of frozen blood components. A device is provided for pivotally supporting the tray within the oven cavity with the tray in engagement with the track, and a device is located within the oven for imparting relative rotation between the tray and the track. The track may be fixed to the bottom of the oven and the tray may be rotated therearound so that the tray is cammed by the track to various levels during the rotation. The pivotal device may be a universal joint so that the tray will rock back and forth across a horizontal plane simultaneously with its rotation so as to optimize distribution of heat between the hotter and colder portions of the blood components. The generally horizontal position of the bag of blood enables the bag to receive maximum microwave energy from a magnetron mounted in the top of the oven.

OBJECTS OF THE INVENTION

An object of the invention is to provide an improved apparatus for heating contained liquid with microwave energy.

A further object is to provide an improved apparatus for thawing frozen bags of blood components with microwave energy.

Another object is to provide an improved apparatus for rocking a bag of frozen blood components about a generally horizontal position below rays of microwave energy.

Still another object is to provide an improved apparatus for thawing frozen bags of blood components in a microwave oven without any alteration of the oven itself.

These and other objects of the invention will become more readily apparent from the ensuing specification when taken together with the drawings.

DESCRIPTION OF THE PREFERRED EMBODIMENT

Figure 1:
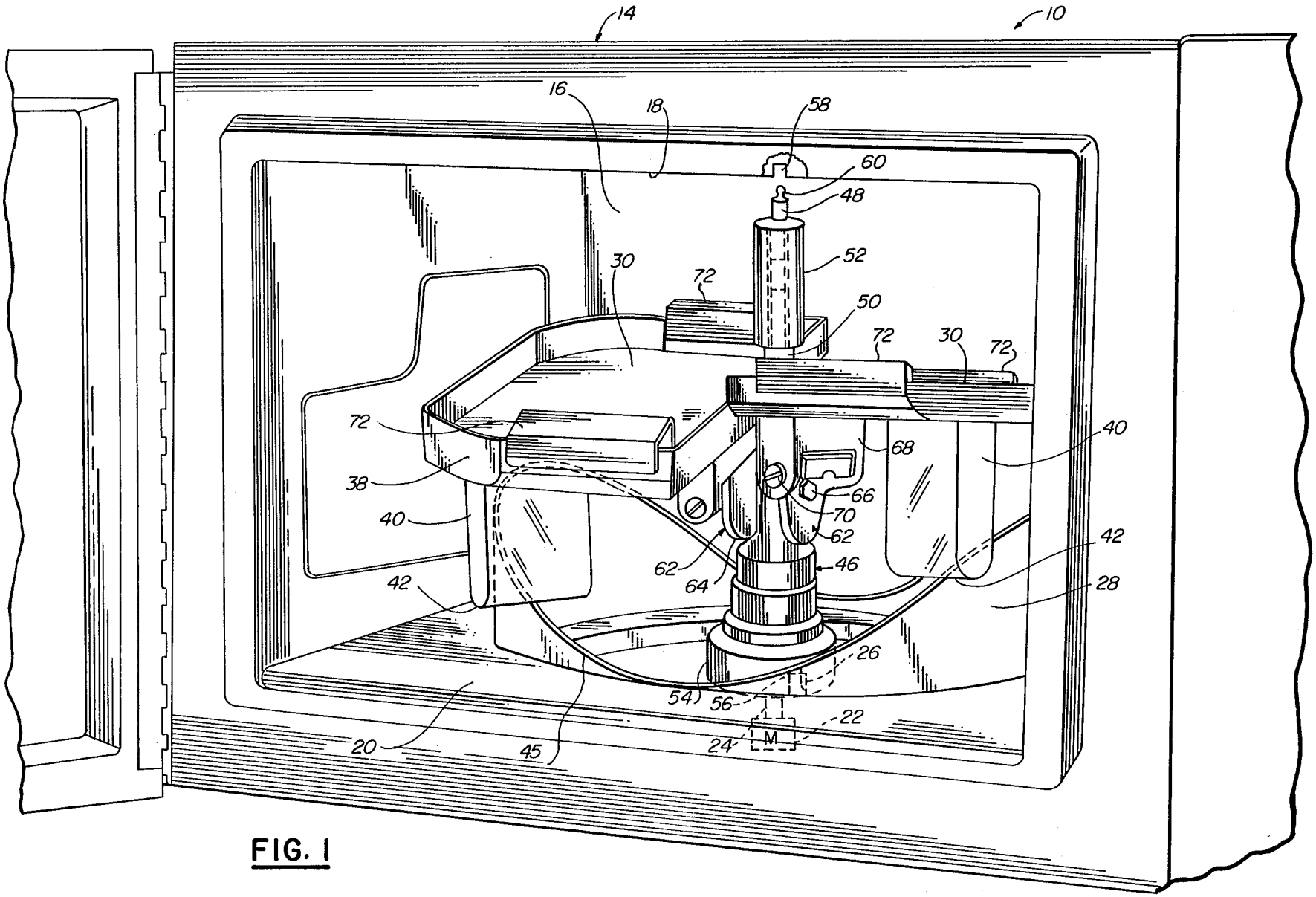
FIG. 1 is a perspective view of the apparatus of the present invention for heating contained liquid or thawing frozen bags of blood components with portions cut away to illustrate various details thereof.
Figure 2:
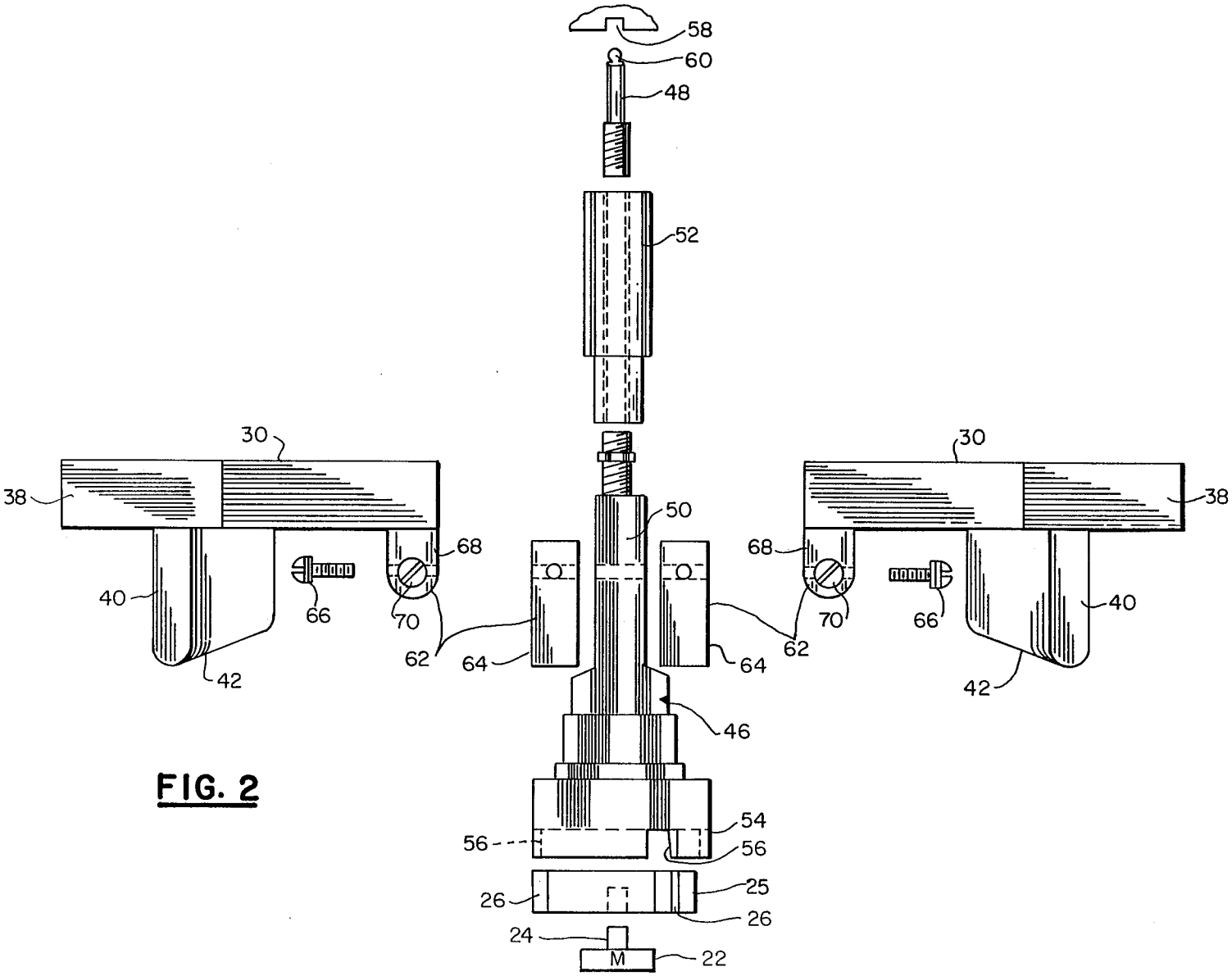
FIG. 2 is an exploded view of part of the mechanism utilized within the microwave oven.
Figure 5:
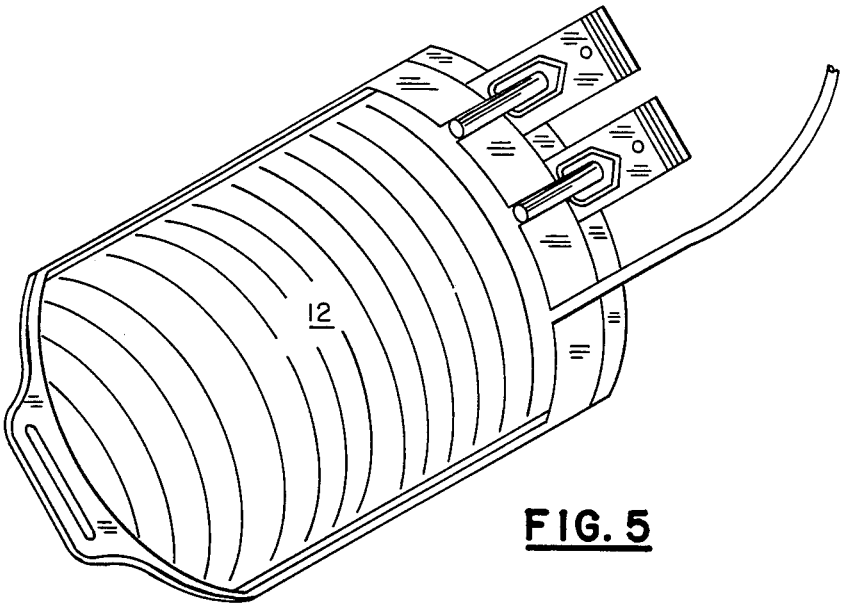
FIG. 5 is a perspective view of a bag of frozen blood components.

Referring now to the drawings wherein like reference numerals designate like or similar parts throughout the several views there is illustrated in FIG. 1 a heating apparatus 10 of the present invention for heating contained liquid, and more particularly for thawing frozen bags of blood components, one such bag being shown at 12 in FIG. 5. The heating apparatus 10 includes a standard carousel microwave oven 14 which is available from Sharp. The microwave oven has a cavity 16 for receiving objects to be heated, the cavity having a top and a bottom which are defined by an oven ceiling 18 and an oven floor 20 respectively. The Sharp manufactured microwave oven has a motor 22 which is located in the oven below the oven floor 20. As shown in FIGS. 1 and 2, the motor has a shaft 24 which extends upwardly into the oven cavity 16 and is attached to a coupler 25 (see FIG. 2) with outwardly extending projections 26. In the standard Sharp microwave oven a flat plate (not shown) rests upon the coupler 25, and the projections 26 of the coupler bear against lands in the bottom of the plate for rotating the plate during operation of the oven. This plate is not utilized in the present invention, and is therefore removed so that the apparatus of the invention can be inserted in the oven for the specialized heating purposes of the invention.

Figure 3:
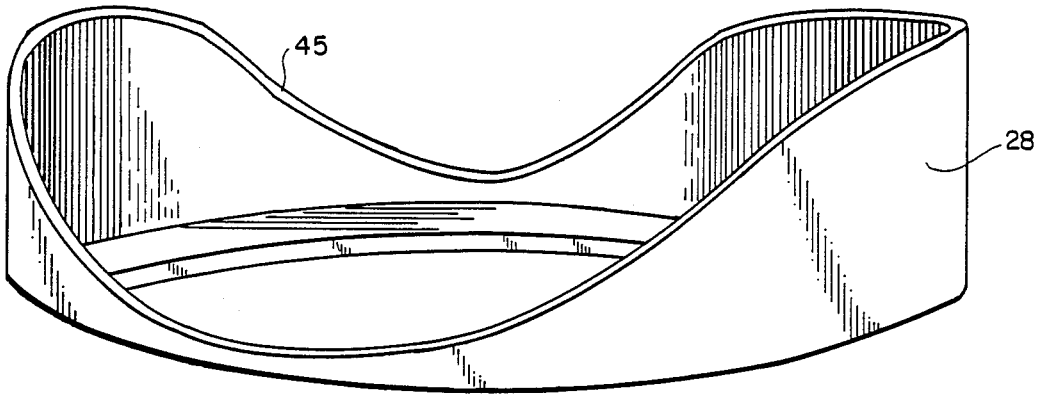
FIG. 3 is a perspective view of the track which is utilized in the heating apparatus.

A track 28 is mounted in the oven cavity and has a peak and a valley with respect to the oven floor 20. The track, which is shown in more detail in FIG. 3, is preferably a circular ring with a plurality of peaks and valleys with respect to the oven floor. The track 28 is constructed of a microwave transparent material, such as plexiglass or polypropylene, and may be fixed in place to the oven floor 20 centrally about the motor shaft 24 by any suitable means such as epoxy cement.

Figure 4:
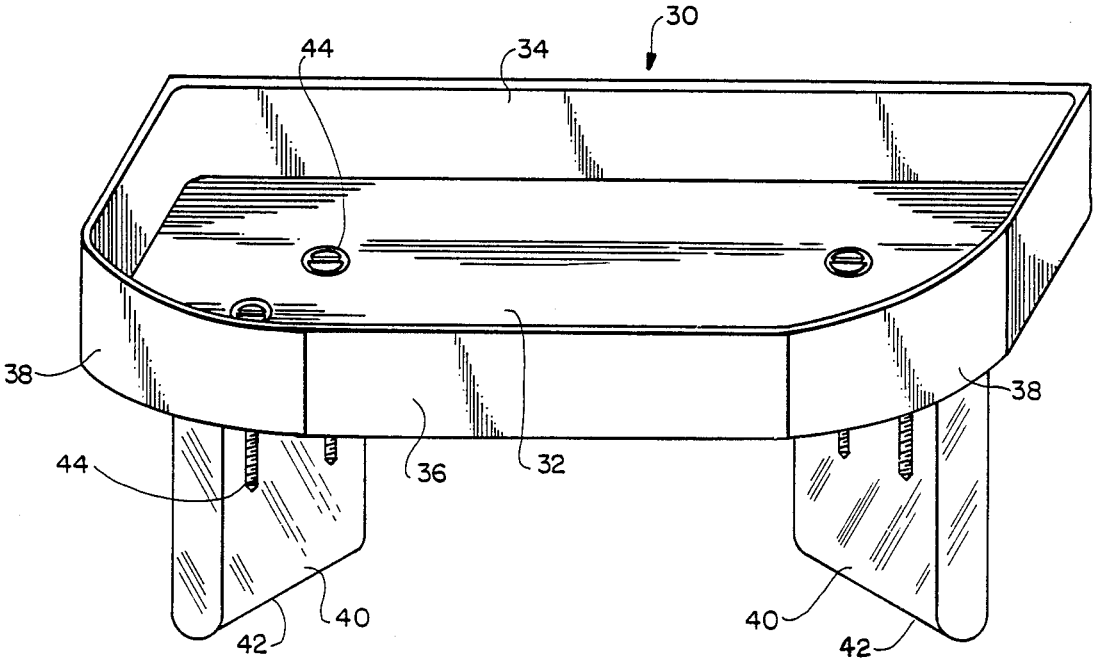
FIG. 4 is a perspective view of a tray utilized in the heating apparatus.

As illustrated in FIG. 1 a pair of trays 30 may be provided, each tray being capable of receiving an object to be heated. As illustrated in FIG. 4, the tray 30 may have a substantially flat bottom 32 and inner and outer sides 34 and 36. Outside corners 38 are rounded for a purpose to be explained thereinafter. The tray 30 has a pair of downwardly extending projections 40 with bottom rounded edges 42. The projections 40 are mounted to the bottom of the tray 30 by any suitable means such as plastic screws 44, and are angled with respect to the tray for a purpose which will be explained in more detail hereinafter. The projections 40 are made of a microwave transparent material, preferably plexiglass or polypropylene.

Means are provided for pivotally supporting the trays 30 within the oven cavity 16 with each tray in engagement with the track 28. In the preferred embodiment the bottom rounded edges 42 of the downwardly extending projections 40 engage the top rim 45 of the track 28. As illustrated in FIGS. 1 and 2 the pivotal support means may include a shaft 46 which has top and bottom portions 48 and 50 which are threaded into a coupler 42 so that the shaft 46 can be lengthened or shortened for proper operation within the oven. The bottom of the bottom shaft section has an enlarged hollow portion 54 with cutouts 56 (one cutout being shown in the drawings) for receiving the projections 26 of the coupler (one such projection being shown in the drawings)which is attached to the motor shaft 24. When the motor 22 is operated the coupler 25 will rotate the shaft 46 within the oven cavity 16. The ceiling 18 of the standard Sharp microwave oven is provided with a hole 58 for receiving a temperature probe (not shown) which is not utilized in this invention. The top of the top shaft portion 48 is provided with a ball extension 60 which is slidably received within the hole 58 when the shaft 46 is sufficiently lengthened by means of the threaded coupler 52. When the ball extension 60 is received within the ceiling hole 58 the shaft 46 is secured in a substantially upright position, as illustrated in FIG. 1.

In the preferred embodiment the pivotal supporting means includes a universal joint 62 for connecting each tray 30 to the shaft 46 at a position above the track 28. (See FIGS. 1 and 2). Each universal joint may include a hub 64 which is rotatably connected to a respective side of the shaft 46 by any suitable means such as a pin or bolt 66. The universal joint further includes a yoke 68 which is secured to the bottom of the tray 30 adjacent its inner edge and which is pivotally connected to the hub 64 by any suitable means such as a pin or bolt 70. With this arrangement each tray can be rocked back and forth in two directions with respect to a horizontal plane when the shaft 46 is rotated by the motor 22. This rocking action in enabled by the camming action of the track 28 on the downwardly extending tray projections 40. In order to provide for an optimum and efficient camming action during rotation the downwardly extending projections 40 extend radially from the shaft 46. With this arrangement the bottom curve 42 of each projection 40 meets the top rin 45 of the track 28 in a square fashion.

Means are located within the oven for imparting relative rotation between the trays 30 and the track 28. In the preferred embodiment this relative rotation imparting means imparts rotation of the trays 30 with respect to the track 28, however it is to be understood that in broader conception of the invention the shaft 46 could be maintained stationary while the track 28 is rotated thereunder. In the preferred embodiment the relative rotation imparting means includes the motor 22 which is connected to the shaft 46 via the coupler 25.

The size of the trays 30 is optimized by the rounded corners 38, which are shown in FIG. 4 and which were mentioned hereinabove. When the trays are rotated the rounded corners 38 enable the tray to clear the sides within the oven cavity. In order to secure objects of various sizes within a tray 30 U-shaped inserts 72 of various sizes are provided which straddle the sides of a respective tray.

The heating apparatus 10 is especially adapted for thawing frozen bags of blood components, such as the frozen bag of blood components 12 shown in FIG. 5. It is extremely important that the blood not boil due to high concentrations of microwave energy. The problem areas in the blood bag are around the edges and the tubing extending from the bag where less volume of the blood is located. The tendency is for the blood at the edges of the bag to heat up and even boil while the larger volume of blood at the center of the bag remains frozen. The rocking movements of the bag in the heating apparatus 10 ensures optimum flow of the heated portions of the blood over the frozen portions thereof.

Figure 6:
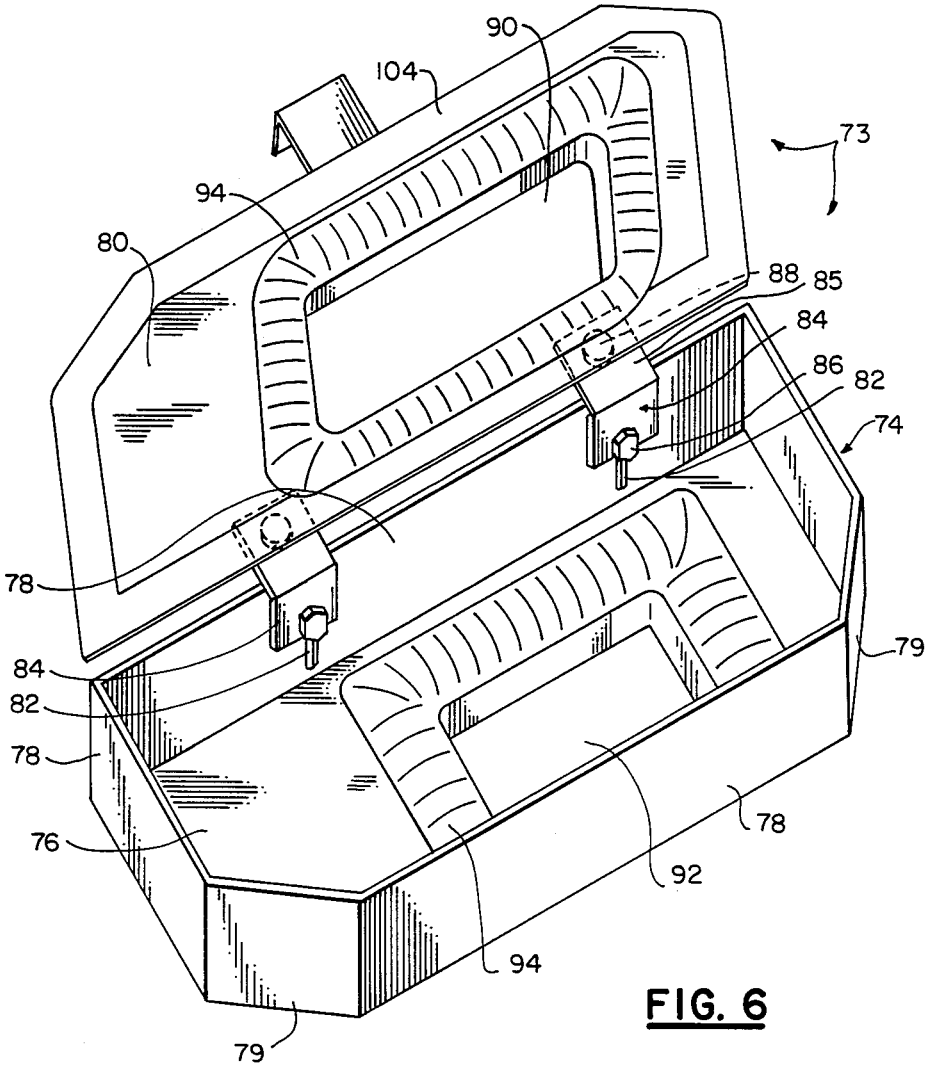
FIG. 6 is a perspective view of an apparatus to be used with the present invention for containing frozen blood bags during microwave thaw.
Figure 10:
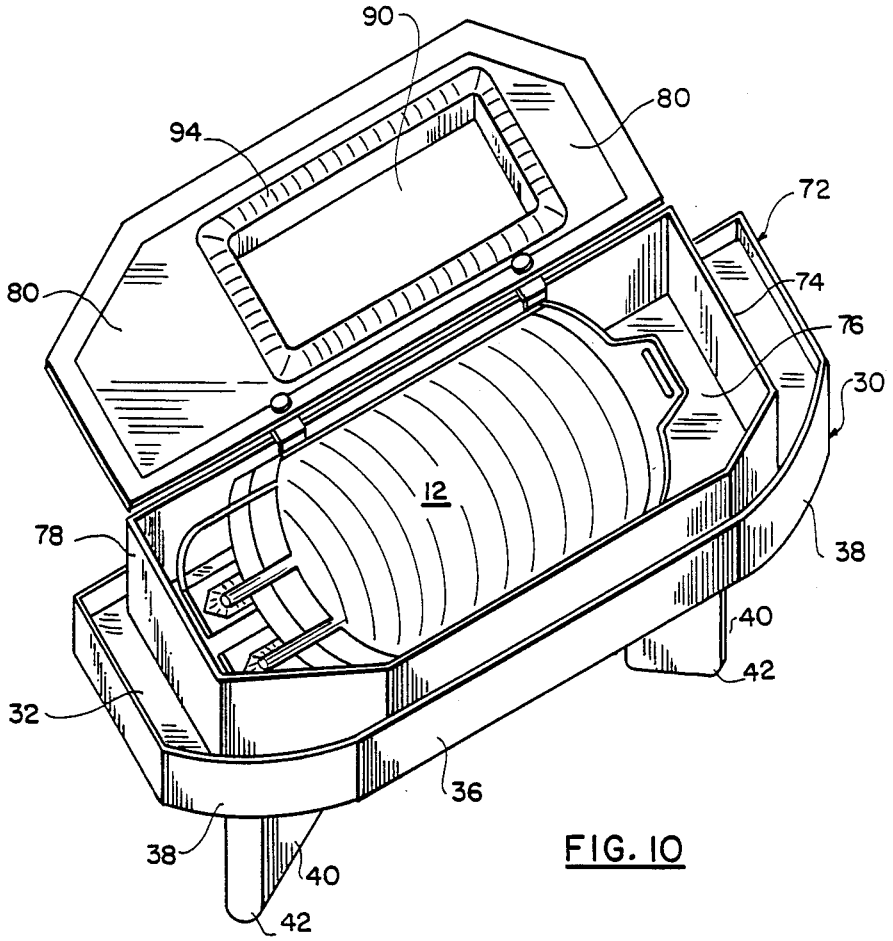
FIG. 10 is a perspective view of a frozen bag of blood components within the container box of FIG. 6, which box is laying within the tray of FIG. 3.

For highly efficient use of the heating unit 10 it is desirable to shield the edges of the blood bag 12 from microwave energy while allowing the microwave energy to penetrate the center more voluminous portion of the blood bag. This has been accomplished by providing an apparatus 73, as shown in FIG. 6, for containing the frozen blood bag 12, this apparatus being utilized with the present invention, shown in FIGS. 1–4. The containing apparatus 73 may include a metallic box 74 which is capable of receiving the blood bag 12, as shown in FIG. 10. As shown in FIG. 6, the container apparatus 73 has a bottom 76 and sides 78 with the sides being angled at the front at 79. A metallic lid 80 is provided, and hinge means 84 are provided for pivotally mounting the lid to the box for closing the blood bag 12 therein.

Figure 9:
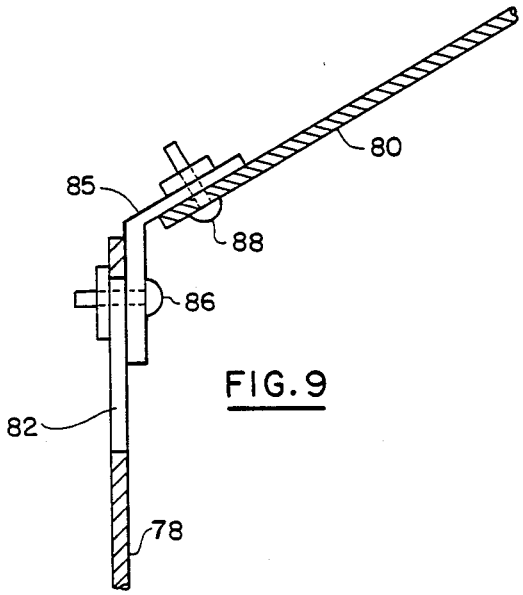
FIG. 9 is a side cross-sectional view of the hinge which supports the lid to the box of the container apparatus of FIG. 6.
Figure 11:
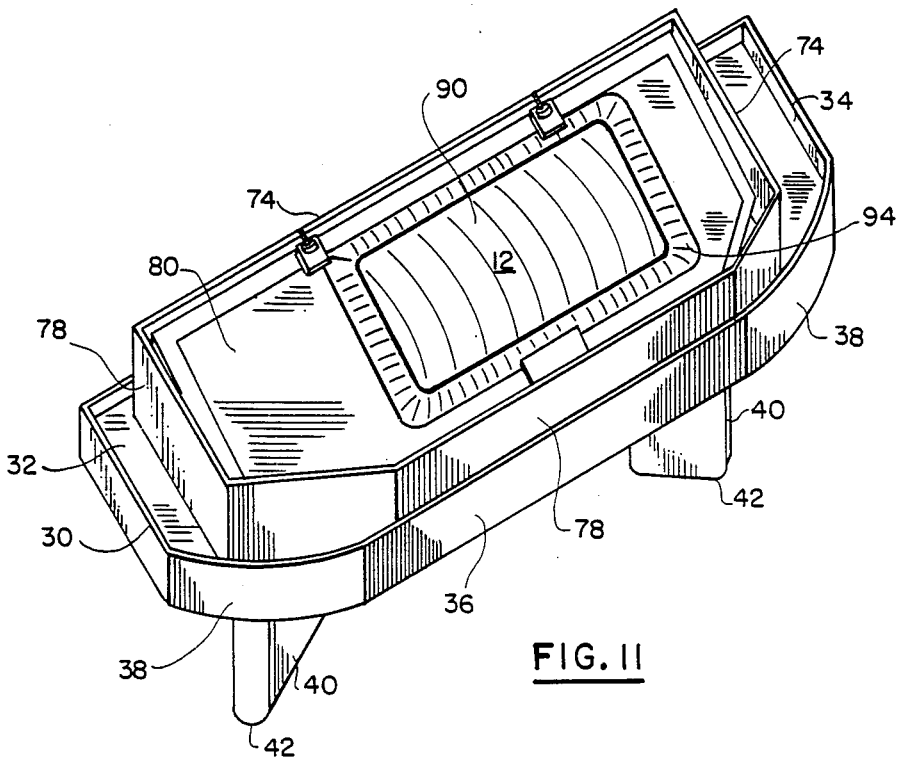
FIG. 11 is the same as FIG. 10 except the lid of the container box is closed.

As shown in FIGS. 6 and 9, the hinge means 84 may include one side of the box 74 having a plurality of vertical slots 82. A plurality of hinges 85 are mounted in the slots 82 and are adjustable up and down therein to various positions. As illustrated in FIG. 9, this may be accomplished by a bolt nut combination 86 which extends through a respective hinge 85 and slot 82. Each hinge 85 may be connected to the edge of the lid 80 by a bolt and nut combination 88. The hinge 85 is constructed of a microwave transparent insulative material, and is preferably a plastic strap which will bend along its center portion. In the preferred embodiment the bolt and nut combinations 86 and 88 are also made of plastic. With this arrangement the lid 80 can be selectively recessed within the box 74 for snugly containing the blood bag 12, as illustrated in FIG. 11.

Figure 7:
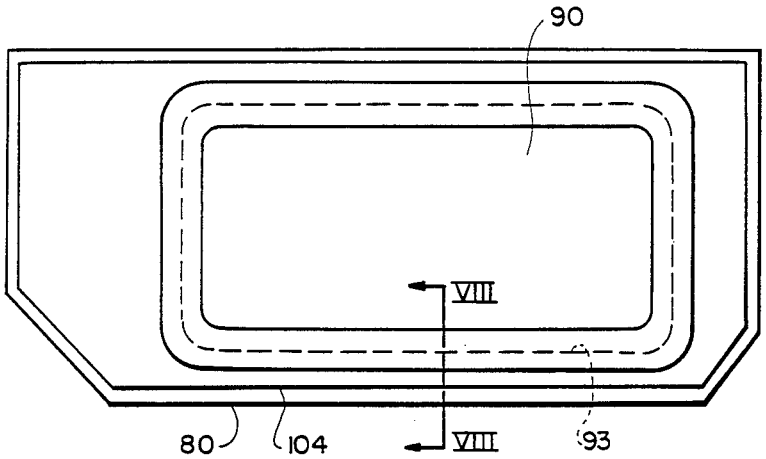
FIG. 7 is a top view of the lid of the container apparatus of FIG. 6.
Figure 8:
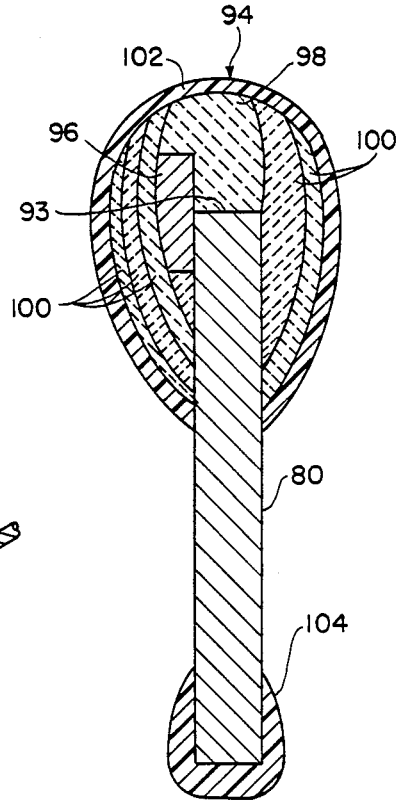
FIG. 8 is a view taken along plane VIII—VIII of FIG. 7 with the details somewhat enlarged for illustration purposes.

As shown in FIGS. 6 and 7 the lid 80 is provided with a central aperture 90 for allowing microwaves to enter the box. It should be noted that the central location of this aperture will allow the microwaves to penetrate the more voluminous portion of the blood components in the central portion of the bag 12. In a like manner the bottom 76 of the box may be provided with a central aperture 92 which is substantially opposite the lid aperture 90 when the lid is closed. The edge of each aperture 90 and 92 is provided with radiation absorbing means 94 for absorbing E field reflections toward the bag, the edge of the lid aperture being shown at 93 in FIGS. 7 and 8. As shown in FIGS. 7 and 8 the radiation absorbing means 94 may include a ring of microwave absorbing material 96 which extends along the peripherial side of the lid aperture closest to the blood component bags. The microwave absorber ring 96 has a width which extends perpendicularly both ways from the edge 93 so as to absorb the E field of microwave energy which is generated along the edge 93 of the aperture.

Means are provided for thermally insulating the ring 96 of absorbing material from the blood bag 12. The thermal insulation means may include a ceramic adhesive 98 which extends between the aperture edge 93 and the ring 96 of absorbing material. Layers of ceramic paper 100 may be laid over the ring of absorbing material 96 and the ceramic adhesive 98 on both sides thereof, and may itself be held in place by ceramic adhesive. A plastic coating 102 may encapsulate the entire assembly to the lid, as shown in FIG. 8. Also, as shown in FIGS. 7 and 8, the entire outer edge of the lid 80 may be coated with several layers of plastic 104. This plastic coating will prevent arcing of the outer edge of the lid to the metallic box 74 when the lid 80 is closed and the assembly is subjected to microwave energy.

FIG. 10 illustrates the blood component bag 12 received within the container apparatus 73, and the container apparatus 73, in turn, received within one of the trays 30. When the lid 80 of the container appraatus is closed into the box 74 (see FIG. 11) the tray 30 is readied for rocking and rotative motions within the microwave oven, as illustrated in FIG. 1. When the trays 30 are loaded with the blood bags 12 in closed containers 73 and then rocked and rotated within the oven 10 the melted portions of the blood components flow over the frozen portions to distribute heat, and the apertures 90 and 92 in the containers 73 will allow heat to penetrate the more voluminous central portions of the blood bags 12. With these combined apparatuses frozen blood bags can be rapidly and efficiently thawed for preparing blood for human use.

Obviously, many modifications and variations of the present invention are possible in the light of the above teachings. It is therefore to be understood that within the scope of the appended claims the invention may be practiced otherwise than as specifically described.

What is claimed is:

1. An apparatus for thawing containers of frozen liquid comprising:

a microwave oven which has a cavity for receiving the containers of frozen liquid,the cavity having a top and a bottom which are defined by an oven ceiling and an oven floor respectively;

generally circular track means fixedly mounted on said floor within the oven cavity and having a plurality of peaks and valleys;

a plurality of trays for supporting the containers of frozen liquid, each tray having a pair of downwardly and radially extending projections;

means pivotally supporting the trays within the oven cavity with the tray projections in engagement with the track means, the pivotally supporting means including a shaft which extends upwardly within the oven cavity and a universal joint which connects each tray to the shaft at a position above the track means;

said shaft having top and bottom portions which are threaded together so that the shaft can be lengthened or shortened;

the ceiling of the oven having a hole for receiving a top portion of the top portion of the shaft; and the lengths of the top and bottom shaft portions and the threading of the two sections enabling extension of the top shaft portion into the ceiling hole for support or withdrawal therefrom; and means located within the oven for rotating the trays with respect to the track means.

2. An apparatus as claimed in claim 1 wherein the relative rotation imparting means includes:

a motor located below the oven floor and removably coupled to the bottom portion of the shaft.

3. An apparatus as claimed in claim 2 including:

each tray having a generally flat bottom which is rockable about a plane which is parallel to the floor of the oven cavity; and each tray having sides wherein the outside corners of the sides are rounded.

4. An apparatus for thawing a container of frozen liquid comprising:

a microwave oven which has a cavity for receiving the container of frozen liquid, the cavity having a top and a bottom which are defined by an oven ceiling and an oven floor respectively;

track means mounted on said floor within the oven cavity and having a peak and a valley;

a tray for supporting the container of frozen liquid, the tray having a downwardly extending projection;

means pivotally supporting the tray within the oven cavity with the tray projection in engagement with the track means, the pivotally supporting means including a shaft which extends upwardly within the oven cavity and a joint which connects the tray to the shaft at a position above the track means;

said shaft having top and bottom portions which are threaded together so that the shaft can be lengthened or shortened;

the ceiling of the oven having a hole for receiving a top portion of the top portion of the shaft;

the lengths of the top and bottom shaft and the threading of the two sections enabling extension of the top shaft portion into the ceiling hole for support or withdrawal therefrom; and means located within the oven for rotating the tray with respect to the track means.

* * * * *